United States Patent [19]

Born

[11] 3,955,588

[45] May 11, 1976

[54] SPRAYING DEVICE FOR A BOTTLE CLEANING MACHINE

[75] Inventor: Gerhard Born, Bingen-Budesheim, Germany

[73] Assignee: Seitz-Werke GmbH, Bad Kreuznach, Germany

[22] Filed: July 11, 1974

[21] Appl. No.: 487,750

[30] Foreign Application Priority Data

July 12, 1973 Germany ..... 2335395

[52] U.S. Cl. ..... 134/129; 134/152; 134/172

[51] Int. Cl.[2] ..... B08B 3/02; B08B 9/08

[58] Field of Search ..... 134/43, 72, 129, 152, 134/167 R, 168 R, 126, 144, 151, 172

[56] References Cited

UNITED STATES PATENTS

| | | | |
|---|---|---|---|
| 688,701 | 12/1901 | Schock | 134/167 R |
| 1,144,023 | 6/1915 | Beutlich | 134/129 X |
| 2,943,424 | 7/1960 | Sadwith | 134/72 |
| 3,225,776 | 12/1965 | Plock et al. | 134/129 |
| 3,561,459 | 2/1971 | Ciongwa et al. | 134/129 X |
| 3,620,233 | 11/1971 | Busse et al. | 134/167 R X |

FOREIGN PATENTS OR APPLICATIONS

| | | | |
|---|---|---|---|
| 360,504 | 11/1931 | United Kingdom | 134/72 |

*Primary Examiner*—Robert L. Bleutge
*Attorney, Agent, or Firm*—Walter Becker

[57] ABSTRACT

A spraying device for a bottle cleaning machine in which bottles are conveyed in inverted position. The spraying device reciprocates in the machine beneath the bottles and includes upwardly directed nozzles that follow respective bottles in succession for a predetermined distance. A cam drive is provided for the device with a guide return. The frame for the spraying device is supported and guided in the machine on antifriction elements. The antifriction elements may include balls rollingly supported by channels in the machine and rollingly engaged by the frame of the spraying device.

10 Claims, 3 Drawing Figures

SPRAYING DEVICE FOR A BOTTLE CLEANING MACHINE

The present invention relates to a spraying device for bottle cleaning machines, which comprises a carriage supporting the spraying tubes and moving during the transport of the bottles, said carriage being longitudinally displaceable on parallel supports within the machine housing.

German Pat. No. 1,120,917 discloses an arrangement according to which the spray pipe carriage intended for the bottle cleaning machines is provided with roller bodies which are rotatable about axles and have the form of wheels or rollers while the carriage is supported by rails and is displaceable thereon. The axles are arranged laterally on the carriage frame and form the bearings for the roller bodies.

Experience has proved that for the rough operation in bottle cleaning machines, spraying carriages equipped with the above mentioned roller bodies are not fully satisfactory. Depending on use thereof in the spray water station, lye station, or acid station, the spraying substances bring about a calcination, crusting or rusting of the axles with the result that the roller bodies get stuck on the axles. The easy movability of the spraying carriage is thus considerably affected. The foregoing, of course, aids in a premature wear of the bearings.

It is, therefore, an object of the present invention to provide a support for the carriage of a spraying device of the above mentioned general type which will do without axle supported roller bodies and thereby will overcome the above mentioned drawbacks. This object and other objects and advantages of the invention will appear more clearly from the following specification in connection with the accompanying drawings, in which:

FIG. 1 diagrammatically illustrates the spray station of a bottle cleaning machine with a spraying device of the bottle transporting mechanism in view.

The spraying device according to the invention is characterized primarily in that the carriage is supported by supports with anti-friction moving and guiding means and is longitudinally displaceable. According to a preferred embodiment of the present invention, the anti-friction moving and guiding means are provided at both sides of the spray carriage within the region of the front and rear ends thereof. Means for support associated with each anti-friction moving and guiding means consist primarily of a U-profile confined by end abutments. This U profile is adapted to the length of the distance over which a ball passes during the displacement of the carriage. This U-profile is provided in a lower plane located opposite the support of the carriage with upwardly directed legs and together with said legs forms a ball guiding means engaging the ball surface at oppositely located points. According to the invention, the distance between the legs of the profile support may be shorter or longer than the ball diameter, and the profile support itself with laterally arranged holding means detachably and vertically adjustably may be connected to the side walls of the machine. According to a further development of the invention, provision is made for purposes of laterally guiding the spray wagon, within the machine likewise to utilize anti-friction moving and guiding means, preferably in the form of balls guided on U-shaped profiles. Such balls may be arranged at both sides of the carriage and may be used for supporting the carriage on the side walls of the machine.

Figure 1:
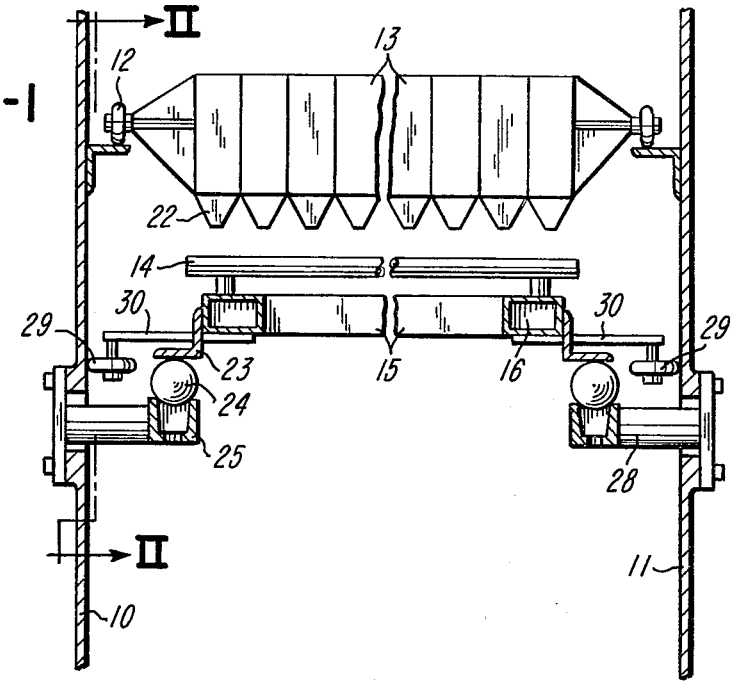
Figure 2:
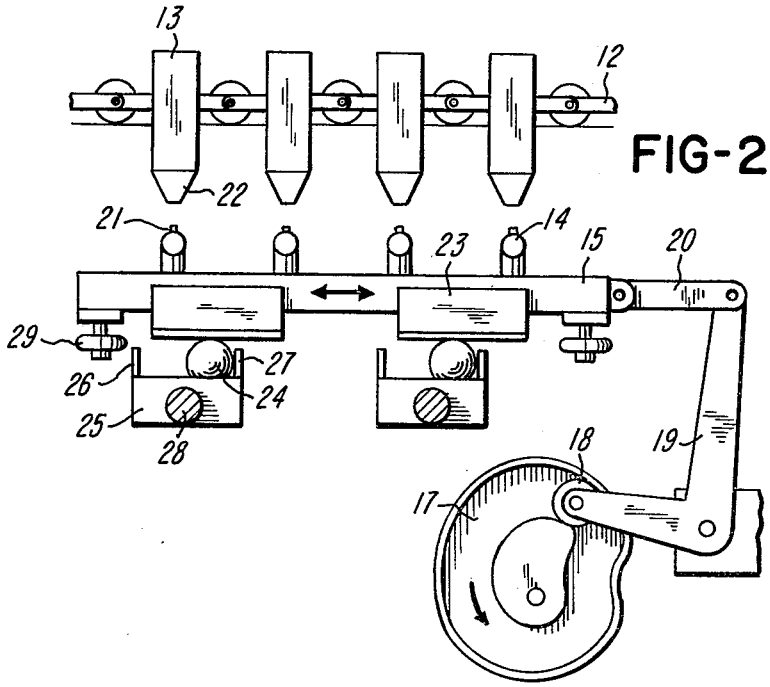
FIG. 2 represents a section taken along the line II-II of FIG. 1.

Referring now to the drawings in detail, FIGS. 1 and 2 show a spray station with a pertaining spraying device for use in connection with a bottle cleaning machine equipped with a plurality of spraying stations, transporting or conveyor means 12 circulating within the region of a side wall 10 and 11, and bottle boxes 13 connected to said chains 12. The device according to the invention as illustrated in the drawings comprises primarily a carriage 15 equipped with a plurality of spraying pipes 14, the frame of said carriage being equipped with pipes 16 for conveying liquid. The pipes 16 serve as distributing means for the spraying pipes 14 connected thereto. The carriage 15 is arranged in the horizontal plane below the conveying path of the bottle boxes 13 and is longitudinally displaceable by means of a cam transmission comprising primarily a cam disc 17, an angle lever 19 provided with a roller 18, and pivotable arm 20. The carriage is longitudinally displaceable in the transporting direction of said bottle boxes and also in opposite direction thereto, and in the box transporting direction, the speed of the carriage corresponds to the advance of the box. Above the displacement distance, the nozzles 21 inserted in the spray pipes 14 are located opposite the downwardly directed box tulips 22 provided with spray openings. The return speed of the carriage 5 exceeds the advance speed of the box.

Figure 3:
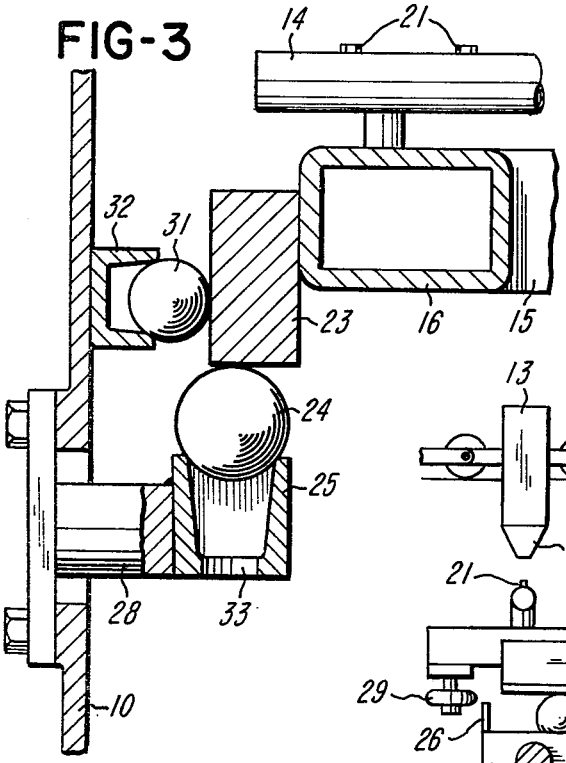
FIG. 3 illustrates a detail of the spraying device according to the invention.

By means of supports 23 located laterally on the frame, the carriage 15 is arranged longitudinally displaceable by means of anti-friction moving and guiding means, expediently with the aid of balls 24 being supported by parallel supports 25. These supports 25 extend along the side walls 10 and 11 of the machine. The supports 25 primarily comprise a U-profile which at its ends is confined by abutments 26, 27. This U-profile is provided in a lower plane located opposite the respective carriage support 23 with the upwardly directed legs and together with the legs forms a ball guiding means effective on the ball surface at oppositely located points. The distance between the legs may be shorter or longer than the ball diameter. If a shorter distance is desired, the ball 24 rests on the leg ends whereas with a desired longer distance the ball rests on the profile base. The length of the supports 25 is respectively adapted to the distance over which a ball 24 passes during the displacement of the carriage 15. In this way, for the machine side walls 10 and 11, two short supports 25 and two supports 23 suffice for the support of the carriage 15 on its front end and rear end. The supports 25, which comprise bores 33 for the discharge of the spray liquid are detachably connected by means of laterally extending holding means 28 relative to the machine side walls 10 and 11. Thus the supports 25 are correspondingly adjustable in conformity with the requirements of the spray station. For laterally guiding the carriage 15, there are additionally provided rollers 29 engaging the machine side walls 10 and 11. These rollers are mounted on bearing means 30 at both sides of the front and rear carriage end. The function of the rollers 29 as evident from FIG. 3 also can be carried out by anti-friction moving and guiding means in the form of balls 31 by means of which the carriage 15 is supported on the machine side walls 10, 11. With such an arrangement, the carriage 15 engages with the supports 23 the respective adjacent ball 31. The balls 31 may be guided also in this instance by U-profiles 32 which are arranged on the machine walls 10 and 11. In such an instance, similar to the arrangement of the supports 25, the distance between the legs may be selected shorter or longer than the ball diameter.

It is, of course, to be understood that the present invention is, by no means, limited to the specific showing in the drawings but also comprises any modification within the scope of the appended claims.

What is claimed is:

1. In combination with a bottle cleaning machine; conveyor means operable to support bottles in inverted position and longitudinally spaced relation while moving the bottles longitudinally, a frame beneath said conveyor means and having upwardly directed nozzles therein spaced in conformity to the spacing of the bottles on the conveyor means, support means supporting said frame for longitudinal movement of displacement to and fro during longitudinal shifting substantially parallel to the movement of said conveyor means, and axleless moving and guiding means for reciprocating said frame on said support means to cause said nozzles to follow respective bottles on said conveyor means in succession for a predetermined length of travel of the bottles on the conveyor means.

2. A bottle cleaning machine in combination according to claim 1 which includes antifriction roller body means guiding said frame on said support means.

3. A bottle cleaning machine in combination according to claim 2 in which said antifriction means includes at least one ball interposed directly between said frame and said support means.

4. A bottle cleaning machine in combination according to claim 2 in which said support means includes a longitudinal upwardly opening channel beneath each side of said frame, said frame having longitudinal members extending laterally therefrom at the sides and positioned over said channels, and at least one ball supported by each channel and engaging the underside of the respective longitudinal member.

5. A bottle cleaning machine in combination according to claim 4 in which each ball is larger in diameter than the distance between the legs of the respective channel.

6. A bottle cleaning machine in combination according to claim 4 in which each channel includes longitudinally spaced abutment plates to limit the amount of travel of the respective ball.

7. A bottle cleaning machine in combination according to claim 4 in which said machine includes a main frame, and means detachably connecting said channels to said main frame for at least vertical adjustability thereon.

8. A bottle cleaning machine in combination according to claim 4 which includes two balls in longitudinally spaced relation beneath each said longitudinal member, a said channel supporting each ball, and longitudinally spaced stop plates on each channel limiting the amount of travel of the respective ball thereon.

9. A bottle cleaning machine in combination according to claim 4 in which said machine includes vertical members at the sides of said frame, and antifriction means on said frame rollingly engaging said vertical members.

10. A bottle cleaning machine in combination according to claim 1 in which said frame includes a longitudinal rail along each side, said machine including channels opening toward the bottom and outside of said rails, and balls between said channels and rails rollingly supporting and guiding said frame.

* * * * *